US006485260B2

(12) United States Patent
Orlowski et al.

(10) Patent No.: US 6,485,260 B2
(45) Date of Patent: Nov. 26, 2002

(54) FAN ASSEMBLY AND METHOD OF MAKING SAME

(75) Inventors: Paul A. Orlowski; Richard W. LaFond, Jr., both of Winsted, CT (US)

(73) Assignee: Nidec America Corporation, Torrington, CT (US)

( * ) Notice: Subject to any disclaimer, the term of this patent is extended or adjusted under 35 U.S.C. 154(b) by 0 days.

(21) Appl. No.: 09/768,565

(22) Filed: Jan. 24, 2001

(65) Prior Publication Data

US 2002/0098086 A1 Jul. 25, 2002

(51) Int. Cl.[7] ..... F04D 29/64

(52) U.S. Cl. ..... 415/213.1; 29/889.3; 415/214.1; 415/220

(58) Field of Search ..... 415/214.1, 220, 415/213.1, 60; 29/888.025, 889.3

(56) References Cited

U.S. PATENT DOCUMENTS 4,780,019 A 10/1988 Johnson et al. ..... 403/195
5,677,829 A 10/1997 Clemens ..... 361/697
5,707,282 A 1/1998 Clements et al. ..... 454/184
5,788,566 A 8/1998 McAnally et al. ..... 454/184
6,071,082 A * 6/2000 Lecinski et al. ..... 361/695

* cited by examiner

*Primary Examiner*—Edward K. Look
*Assistant Examiner*—Kimya N McCoy
(74) *Attorney, Agent, or Firm*—Cummings & Lockwood

(57) ABSTRACT

A fan assembly has a fan housing defining mounting apertures, a sheet metal mounting member for mounting the fan housing thereon, mounting tabs extending outwardly of the mounting member and received within the mounting apertures of the fan housing, and threaded fasteners received within the mounting apertures of the fan housing and engaging both the mounting tabs and the fan housing to secure the fan housing to the mounting member. Each mounting tab is formed by piercing the sheet metal mounting member with a forming tool, and moving the forming tool through the pierced mounting member to thereby move the pierced metal in the shape of the tab outwardly of the mounting member. The mounting tabs are received within the mounting apertures of the fan housing, and self-tapping fastener are inserted into the mounting apertures of the fan housing and engage both the fan housing and the mounting tabs to secure the fan housing to the mounting member.

38 Claims, 6 Drawing Sheets

FAN ASSEMBLY AND METHOD OF MAKING SAME

FIELD OF THE INVENTION

The present invention relates to a fan assembly for cooling electronic devices, and more particularly, to a fan assembly that defines a smooth exterior surface to facilitate slidably engaging a receiving surface for mounting the fan assembly thereto.

BACKGROUND INFORMATION

Typical electronic devices, such as computers, incorporate internal cooling fans and blowers in order to maintain the temperatures of other internal components within specified design limits. The determination of optimal air flow requirements is based upon consideration of the thermal aspects of the layout of the device enclosure. The proper placement of an internal cooling fan in relation to the other internal components can significantly reduce the air flow rate required to achieve the desired cooling characteristics, and in turn reduce the associated power and noise characteristics by employing a smaller-sized fan. However, the close packaging of internal components to attain minimum package size often results in some obstruction to or deflection of the air stream in a location near the fan.

In order to achieve optimal performance, cooling fans are mounted onto an internal surface of the enclosure at a specified location. Generally, the means employed for mounting these cooling devices are limited by the relative ease of assembly and disassembly, the time required for assembly and disassembly, and the associated costs. Such fan assemblies typically include a fan housing secured to a mounting member. The configuration of the exterior surface of the mounting member opposite the surface to which the fan is mounted is of particular importance. For tube axial fans, it is frequently necessary that such fans be mounted flush to the receiving surfaces of the enclosures (referred to as "flush face tube axial fan attachment"). Thus, in order to achieve this condition, it is necessary for the mounting member to define a smooth exterior surface.

It is known in the prior art that inserting a fastener from the exterior surface of a mounting member to secure a fan housing thereto will interrupt the exterior surface of the mounting member and prevent flush face tube axial fan attachment. For example, the heads of screws inserted through a mounting member to secure a fan housing thereto will interrupt the exterior surface of the mounting member and thereby prevent the fan assembly from mounting flush to the receiving surface of the enclosure. One known method for mounting a fan housing to a mounting member that overcomes this problem incorporates threaded standoffs attached to a sheet metal mounting panel. The threaded standoffs are press fit into the sheet metal mounting panel, and the free ends of the standoffs are received within the mounting apertures of the fan housing. Then, screws are inserted into the mounting apertures and threadedly engage the standoffs to fixedly secure the housing to the panel. Because the threaded standoffs are press fit into the sheet metal panel, the side of the panel opposite the fan housing maintains a smooth and flush surface to thereby allow flush face tube axial fan attachment. One of the drawbacks of this prior art approach, however, is that the threaded standoffs are relatively expensive and therefore involve increased manufacturing costs associated with purchasing and maintaining an inventory of such standoffs. Another drawback of this prior art approach is that it involves increased. production time for installing the threaded standoffs, particularly when multiple fan attachments are required.

Other known methods for mounting fan housings to mounting members or other sheet-like surfaces incorporate a variety of constructions generally comprising prefabricated, self-locking protuberances on a fan frame and extending through cooperative receptacles formed in the sheet-like surface. For example, U.S. Pat. No. 5,788,566 to McAnally et al. ("the '566 patent") shows four prefabricated mounting hooks formed on respective corners of a fan housing and extending outwardly therefrom. Four corresponding slots are formed in the wall of a computer housing for receiving the mounting hooks. As further described in the '566 patent, the fan housing is advanced towards the wall until the mounting hooks extend through the slots in the wall and are releasably locked therein.

Similarly, U.S. Pat. No. 5,677,829 to Clemens ("the '829 patent") shows four prefabricated upstanding comer posts formed on respective comers of a mounting member for engaging corresponding slots in a fan housing. Each comer post is bifurcated so that it compresses as it is pushed into the corresponding slot. The opposite side of the mounting member includes downwardly projecting tabs for locking the fan assembly to a heat sink. Likewise, U.S. Pat. No. 5,707,282 to Clements et al. ("the '282 patent") shows a method for mounting a fan housing to a mounting member in the form of a diffuser by employing a plurality of rearwardly extending posts prefabricated on the diffuser that engage corresponding apertures in the fan to restrain lateral movement of the fan relative to the diffuser. The '282 patent further shows parallelepiped projections extending outwardly from the opposite side of the diffuser for mounting to a support.

One of the drawbacks associated with these prior art approaches is that they necessarily require the protuberances to extend through the mounting surfaces and thereby create an interrupted, uneven exterior surface opposite the mounted fan. As a result, these prior art assemblies cannot be used to achieve flush face tube axial fan attachment.

Accordingly, it is an object of the present invention to overcome one or more of the above-described and other drawbacks and disadvantages of the prior art.

SUMMARY OF THE INVENTION

The present invention is directed to a fan assembly for cooling electronic devices, and a method of making such a fan assembly. The fan assembly includes a fan housing defining a plurality of mounting apertures, and a mounting member for mounting the fan housing thereon. The mounting member is preferably in the form of a sheet metal panel, and includes a plurality of mounting tabs extending outwardly of the mounting member and received within the mounting apertures of the fan housing. An aperture is formed adjacent to each mounting tab and extends through the mounting member. Threaded fasteners are received within the mounting apertures of the fan housing, and engage both the mounting tabs and the fan housing to secure the fan housing to the mounting member.

The method of making the novel fan assembly includes piercing the mounting member in a predetermined shape, and moving the pierced metal outwardly of the mounting member to form each mounting tab. The fan housing is placed onto the mounting member, and the mounting tabs are received within the mounting apertures of the fan housing. To complete the assembly, fasteners, such as self-tapping screws, are inserted into the mounting apertures of the fan housing from the side opposite the mounting member. The fasteners engage both the fan housing and the mounting tabs to secure the fan housing to the mounting member.

One advantage of the present invention is that it eliminates the costs associated with purchasing and maintaining an inventory of extra parts associated with assembling the fan housing to the mounting member, such as threaded standoffs. In addition, the elimination of such extra parts reduces the time required to assemble the fan housing to the mounting member. Another advantage of the present invention is that the novel method of forming the mounting tabs out of the mounting member, and extending the mounting tabs into the corresponding mounting apertures of the fan housing, does not disrupt the smooth exterior surface of the mounting member opposite the fan housing. As a result, the fan assemblies of the present invention are particularly well suited for flush face tube axial fan attachment.

Other objects and advantages of the present invention will become apparent in view of the following detailed description of the preferred embodiments and accompanying drawings.

DETAILED DESCRIPTION OF THE PREFERRED EMBODIMENTS

Figure 1A:
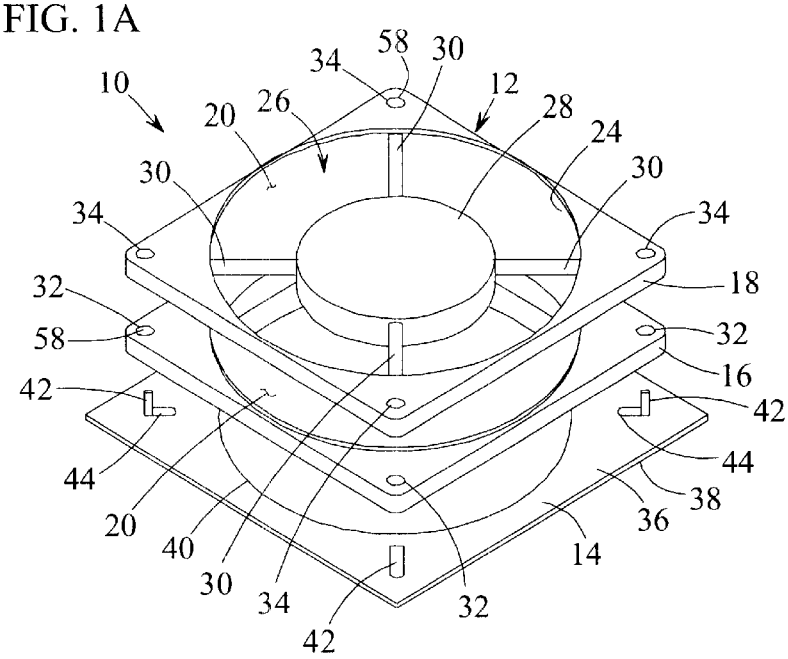
FIG. 1A is an exploded, top perspective view a fan assembly of the present invention.
Figure 1B:
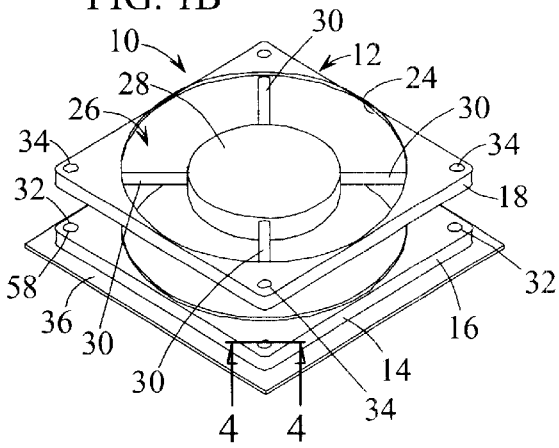
FIG. 1B is a top perspective view of the fan assembly of FIG. 1A in a fully assembled condition.
Figure 1C:
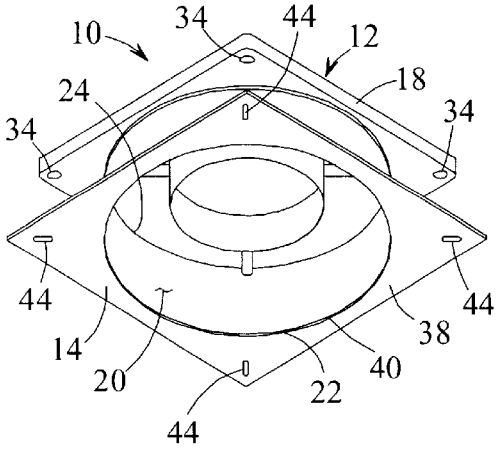
FIG. 1C is a bottom perspective view of the fan assembly of FIG. 1A in a fully assembled condition.

In FIGS. 1A through 1C, a fan assembly embodying the present invention is indicated generally by the reference numeral 10. The fan assembly 10 comprises a fan frame 12 seated on a mounting member 14. The fan frame 12 defines a lower flange 16 seated on the mounting member 14 when assembled. The fan frame 12 further defines an upper flange 18 spaced laterally from the lower flange 16, and a plenum 20 extending between and joined to the lower flange 16 and upper flange 18. The lower flange 16 includes a lower fan aperture 22 and the upper flange 18 includes an upper fan aperture 24. The plenum 20 defines a plenum chamber 26 extending between the lower and upper fan apertures 22 and 24, respectively, for the movement of air therethrough. The fan assembly 10 further comprises a motor 28 for turning a plurality of fan blades (shown in FIG. 5). A plurality of struts 30 are radially spaced relative to each other and extend between the upper flange 18 and motor 28 to support the motor. The lower flange 16 and upper flange 18 further include a plurality of mounting apertures 32 and 34, respectively, located in each comer of the respective flange.

As further shown in FIG. 1A, the mounting member 14 defines a first surface 36 facing and supporting the lower flange 16, and a second surface 38 on the opposite side of the mounting member 14 relative to first surface 36. In addition, the mounting member 14 defines a fan aperture 40 of approximately the same size and shape as the fan apertures 22 and 24, and is aligned with the fan apertures and plenum chamber 26 to thereby extend the plenum chamber through mounting member 14.

Figure 2C:
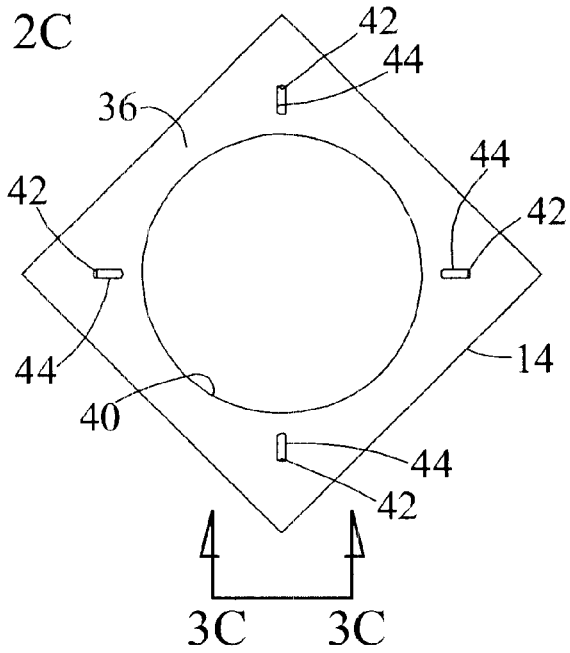
FIG. 2C is a top plan view of the mounting member of FIG. 2A.
Figure 2B:
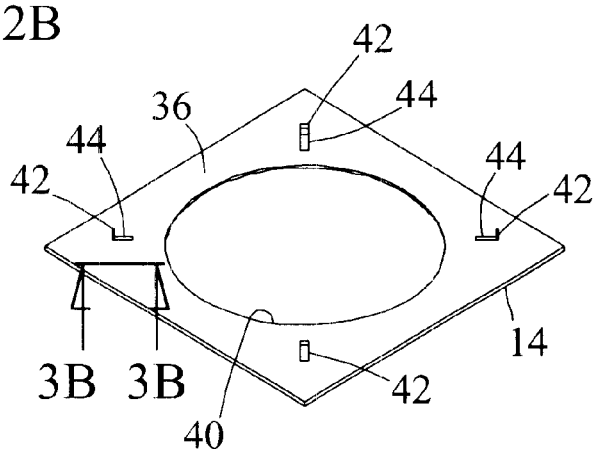
FIG. 2B is a top perspective view of the mounting member of FIG. 2A.
Figure 2A:
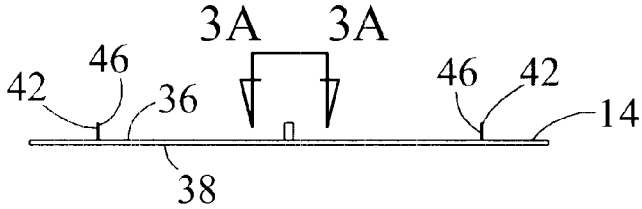
FIG. 2A is a side elevational view of a mounting member for mounting the fan housing thereon as shown in FIG. 1A.

Turning to FIGS. 2A through 2C, the mounting member 14, when prepared for assembly, includes a plurality of mounting tabs 42 extending outwardly of the first surface 36. The mounting tabs 42 are typically oriented approximately perpendicular to the first surface 36 of the mounting member 14. In the embodiment illustrated in FIG. 1A, the mounting tabs 42 are received within the mounting apertures 32 of the lower flange 16. The mounting member 14 further defines a plurality of mounting member apertures 44, each formed contiguous to a base 46 of a respective mounting tab 42. The mounting member apertures 44 extend through the mounting member 14 from first surface 36 to the second surface 38 thereof.

Figure 3A:
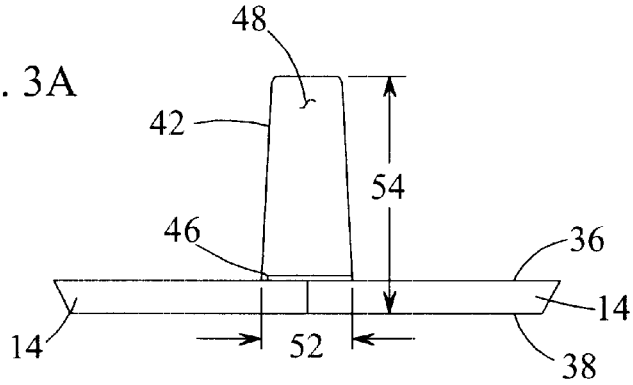
FIG. 3A is a front elevational, detailed view of a mounting tab integrally formed in the mounting member of FIG. 2A.
Figure 3B:
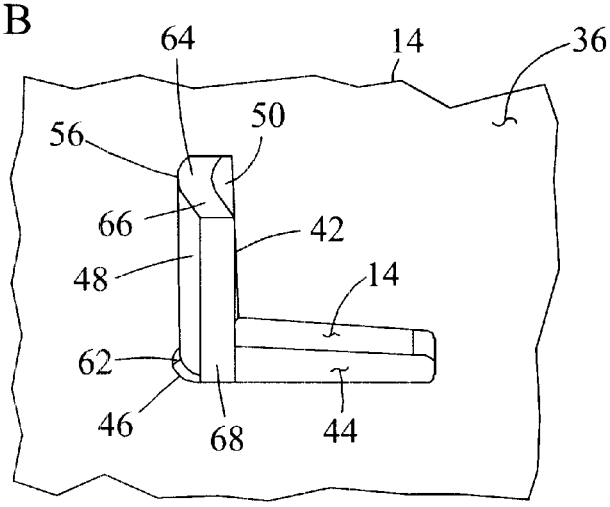
FIG. 3B is a perspective view of the mounting tab of FIG. 2A.
Figure 3C:
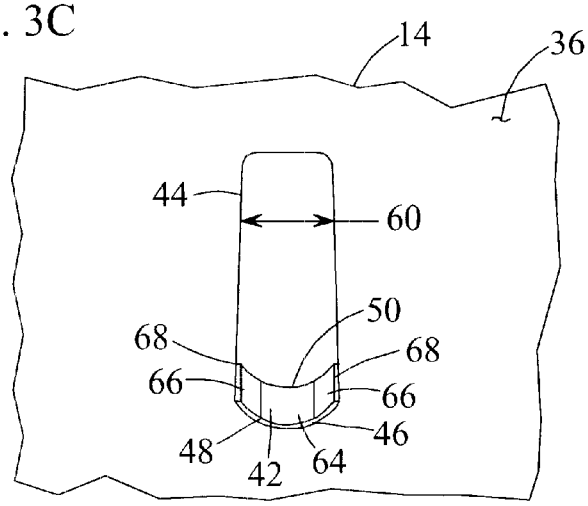
FIG. 3C is a top plan view of the mounting tab of FIG. 2A.

As shown in detail FIGS. 3A through 3C, each mounting tab 42 defines an exterior surface 48, an interior surface 50, a first width 52 at the base that tapers to a second width 60, and a height 54 for receipt within a respective mounting aperture 32 in the lower flange 16. The exterior surface 48 defines a curvature 56 corresponding to the curvature of the interior surface 58 of the mounting apertures 32 of the fan housing. The base 46 of each mounting tab 42 defines an area of transition 62 extending between the first surface 36 of the mounting member 14 and the exterior surface 48 of the mounting tab 42. In addition, the top surface 64 of each mounting tab 42 includes comers 66 of sufficient radii to form a smooth transition from the top surface to the side surfaces 68 of the mounting tab.

The mounting tabs 42 and corresponding mounting member apertures 44 are formed in the mounting member 14 by any one of numerous different metal-forming processes that are currently or later become known for forming the tabs as disclosed herein, such as stamping, punching, or pressing. In addition, any one of numerous different types of forming tools that are currently or later became known for performing these processes, such as a die or a punch, is applied to the mounting member 14 during the metal-forming process to pierce the mounting member, and thereby form the mounting tabs 42 in locations corresponding to the mounting apertures 32 of the fan frame 12. In a continuing motion following the piercing of the mounting member 14, the die, punch, or like forming tool moves the pierced metal outwardly of the first surface 36 of the mounting member to thereby form the upstanding mounting tabs 42 and the corresponding mounting member apertures 44. By applying a metal-forming process as described herein, the second exterior surface 38 of the mounting member 14 retains a smooth exterior surface for flush face tube axial fan attachment.

As may be recognized by those skilled in the pertinent art based on the teachings herein, numerous known metal cutting processes can be used as an alternative to piercing the mounting member 14. For example, the mounting tabs 42 can be formed in the mounting member 14 by application of a laser, torch, waterjet, or other cutting means. However, a relatively higher amount of parent material of the mounting member 14 is consumed during such a cutting operation. In addition, a second step is required involving moving the mounting tabs 42 outwardly of the first surface 36 of the mounting member 14 to form the upstanding mounting tabs and the corresponding mounting member apertures 44. Nonetheless, the formation of the mounting tabs 42 by these or any other method has no significant impact on the function of the mounting tabs.

Figure 4:
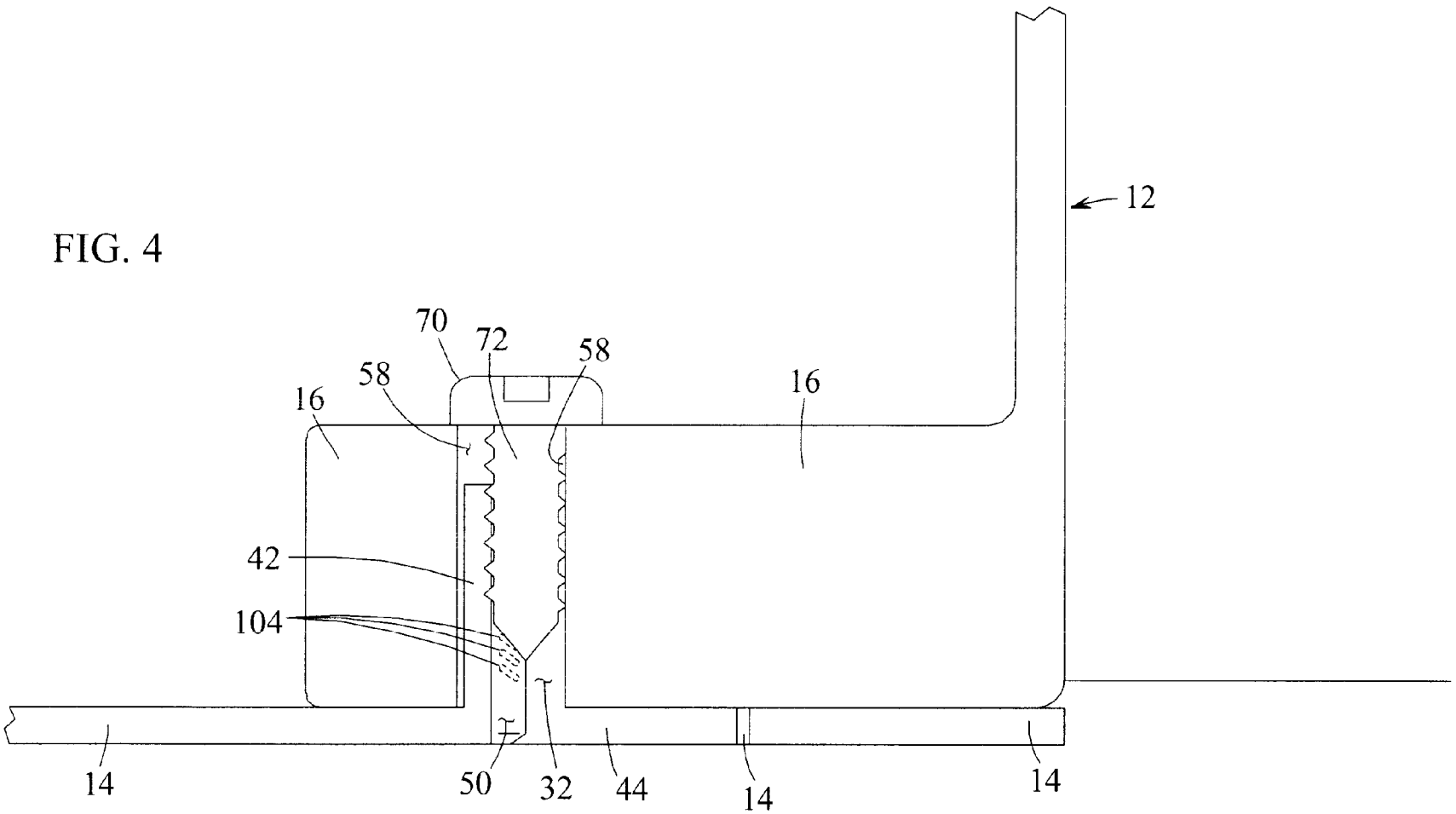
FIG. 4 is a partial, cross-sectional view of the fan housing of the fan assembly of FIG. 1A showing the mounting tab received within the mounting aperture of the fan housing and threadedly engaged by the fastener.

As shown in FIG. 4, the mounting tab 42 and the mounting member aperture 44 have been formed in the mounting member 14. The mounting tab 42 extends outwardly of the mounting member 14 and is received within the mounting aperture 32 of the lower flange 16. A fastener 70 is received within the mounting aperture 32 and engages both the interior surface 50 of the mounting tab 42 and the interior surface 58 of the mounting aperture 32 to secure the lower flange 16 to the mounting member 14. In a preferred embodiment of the invention and as shown in FIG. 4, the fastener 70 threadedly engages the interior surface 50 of the mounting tab 42 and the interior surface 58 of the mounting aperture 32. Preferably, the fastener 70 comprises a self-tapping screw 72, and the interior surface 50 of the mounting tab 42 and the interior surface 58 of the mounting aperture 32 define a curvature corresponding to that of the self-tapping screw.

Figure 5:
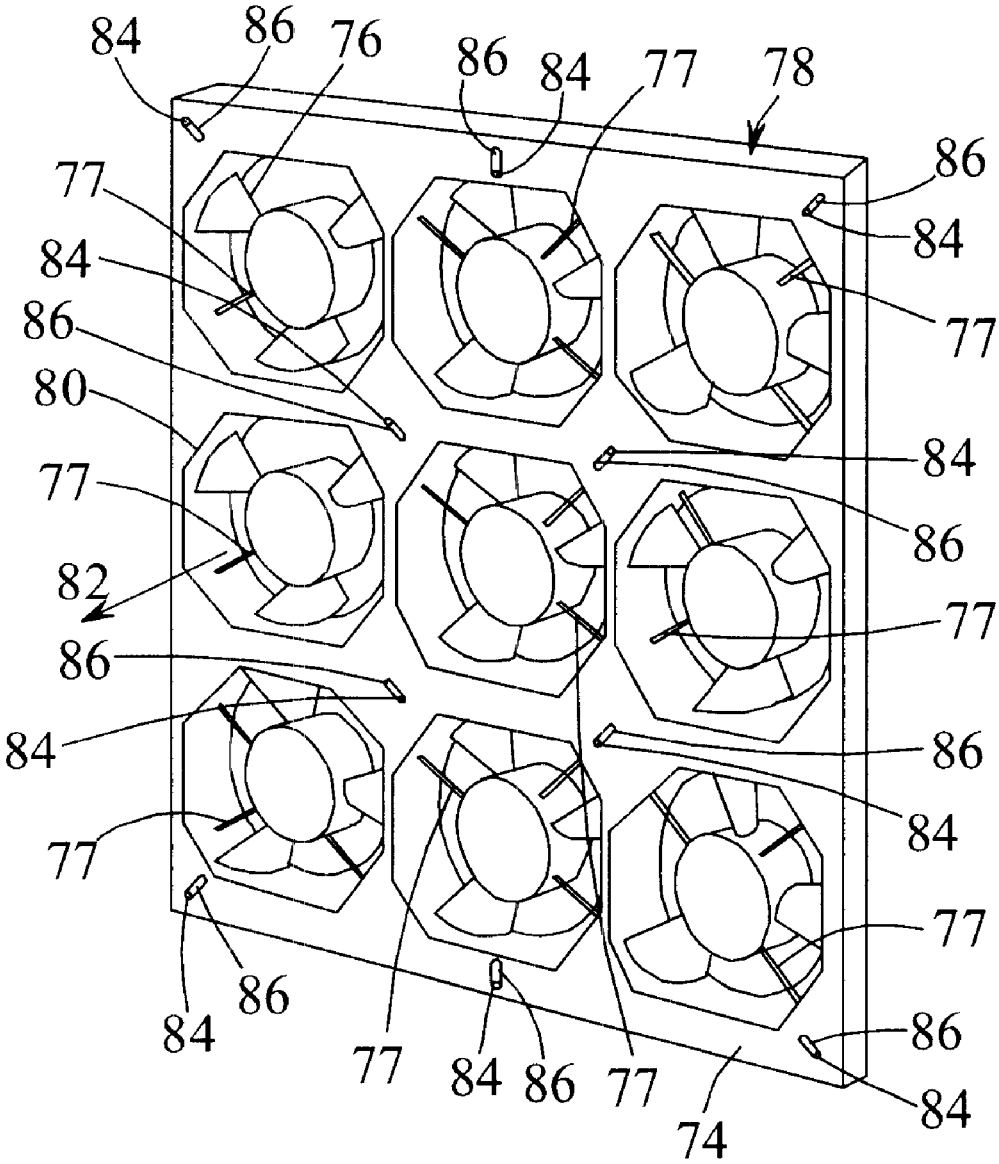
FIG. 5 is a perspective view of a rack enclosure including multiple fan assemblies secured to a mounting member in accordance with the present invention.

As may be recognized by those skilled in the pertinent art based on the teachings herein, the mounting member 14 may define any one of numerous different shapes and configurations. As shown in FIGS. 1B and 1C, the mounting member 14 is in the form of a sheet defining an approximately planar shape. Alternatively, and as shown in FIG. 5, the mounting member 14 can define a rack 74 to which a plurality of fans 76, housed within fan frames 77 and spaced relative to each other, may be mounted to form a rack assembly 78. As shown, the rack 74 defines a plurality of apertures 80 corresponding to each plenum chamber 82 through which air is moved. The rack 74 further defines a plurality of mounting tabs 84 and corresponding rack member apertures 86 spaced adjacent to apertures 80. The mounting tabs 84 are received within the corresponding mounting apertures of the fan frames 77 to secure the fan frames 77 to the rack 74.

Figure 6B:
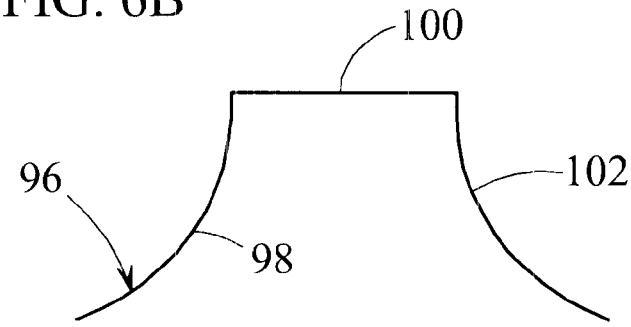
FIG. 6B is a somewhat schematic view of another embodiment of the mounting member of FIG. 2A.
Figure 6A:
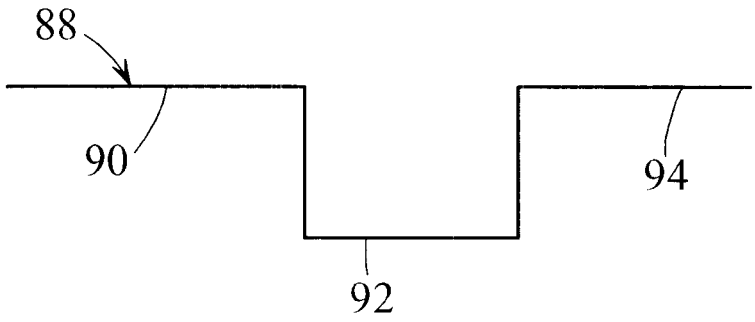
FIG. 6A is a somewhat schematic view of another embodiment of the mounting member of FIG. 2A.

Accordingly, as may be further recognized by those skilled in the pertinent art based on the teachings herein, the mounting member 14 may define any of numerous different shapes or configurations, or any of numerous different materials. Preferably, however, the mounting member is made of sheet metal to allow formation of the mounting tabs as described above, and defines one or more smooth exterior surface portions for flush face fan attachment of each such portion. As shown in FIG. 6A, the exemplary mounting member 88 may define a first relatively raised section 90, a second relatively recessed section 92, and a third relatively raised section 94. A fan housing may be flush face mounted according to the present invention to either the first section 90, the second section 92, or the third section 94. Alternatively, and as shown in FIG. 6B, the exemplary mounting member 96 may define a first curvilinear section 98, a second approximately planar section 100, and a third curvilinear section 102. A fan housing may be flush face mounted according to the present invention to the second section 92. Similarly, the mounting member 14 may define an exterior wall of a housing of a computer or other electronic device to which a fan frame 12 may be mounted.

As also may be recognized by those skilled in the pertinent art based on the teachings herein, the fan or fan frame 12 can take any one of numerous different configurations and still be employed in accordance with the present invention. For example, the present invention may be employed in connection with both tube axial fans and centrifugal blowers. In addition, those skilled in the pertinent art my recognize based on the teachings herein that any other housing or like structure may be mounted to a mounting member, such as a sheet metal panel, in accordance with the present invention. For example, a wire harness may be mounted to a sheet metal panel forming an electronic enclosure in accordance with the present invention.

As also may be recognized by those skilled in the pertinent art based on the teachings herein, the fan frame 12 and the mounting member 14 may be fabricated from any one of numerous different materials that are currently, or later become known for forming these types of components, such as metal or polymeric materials. A preferred embodiment of the invention comprises a fan frame 12 fabricated from one-piece zinc or aluminum to provide mechanical strength to the assembly, and a mounting member 14 fabricated from sheet metal to facilitate piercing the mounting member 14 and forming the upstanding mounting tabs 42 and corresponding mounting member apertures 44 in one metal-forming operation as described above.

Selection of the material from which the fan frame 12 and the mounting member 14 are fabricated correspondingly defines the type of fastener 70 for use in mounting the fan frame 12 to the mounting member 14. For example, when the mounting tabs 42 are fabricated from metal, and the fan frame 12 similarly is fabricated from metal, the fastener 70 is likewise preferably fabricated from metal. Alternatively, mounting tabs 42 and mounting apertures 32 both fabricated from plastic can be threadedly engaged by a fastener 70 fabricated from plastic or metal.

If the mounting member 14 is fabricated from metal and the fan frame 12 is fabricated from plastic, a fastener 70 fabricated from metal may more readily threadedly engage the relatively softer plastic of the mounting apertures 32 than the relatively harder metal mounting tabs 42. As a result, the fastener 70 may shift toward the plastic surface forming the respective mounting aperture 32 and strip the newly formed threads therein. To overcome this shift of the fastener 70, a plurality of dimples 104 as shown in FIG. 4, or like surface irregularities, can be formed on the mounting member 14 prior to forming the mounting tabs 42. For example, prior to the process of piercing the mounting member 14, any one of numerous different types of forming tools that are currently or later became known for performing these processes, such as a die or a punch, may be applied to the mounting member 14 to form a plurality of dimples 104 or like surface irregularities on the surfaces 50 of the mounting tabs 42. Subsequently, the mounting tabs 42 are formed according to the present invention by applying a second punch, die, stamp, or suitable metal forming tool to pierce the mounting member 14 and move the pierced metal outwardly into the shapes of the mounting tabs. As a result, the surface 50 of each mounting tab 42 defines the dimple 104 or like surface configuration for facilitating threadedly engaging the self-tapping screw 72. Accordingly, the self-tapping screw 72 threadedly engages both the mounting tabs 42 and the mounting apertures 32 without noticeably shifting toward the plastic-formed surfaces defining the mounting apertures 32, and a plastic fan frame 12 can be mounted to a metal mounting member 14.

As may be recognized by those skilled in the pertinent art based on the teachings herein, numerous other changes and modifications may be made to the above-described and other embodiments of the present invention without departing from its scope as defined in the appended claims. For example, numerous different types of fasteners that are currently or later become known for performing the function of the fasteners 70 can be employed, such as screws, rivets, and pins, and such fasteners can be made of any of numerous different materials. Alternatively, the fasteners 70 may be formed by, or integral with the mounting tabs 42. For example, the mounting tabs and corresponding mounting apertures in the fan housing may be shaped and configured to frictionally engage one another upon inserting the tab into the aperture to thereby fasten the housing to the mounting member. Similarly, a surface portion of the mounting tab may be formed into a tang, protuberance, or other shape configured to engage a corresponding recess or other surface portion of the housing to thereby fasten the housing to the mounting member. In addition, the fan housing and the mounting member can take numerous different shapes or configurations, and can be fabricated from numerous different materials. Similarly, the mounting tabs and corresponding apertures can take any of numerous different shapes, and can include any preferred number of such tabs. Accordingly, this detailed description of preferred embodiments is to be taken in an illustrative, as opposed to a limiting sense.

What is claimed is:

1. A fan assembly comprising:

a fan frame defining at least one first aperture and a first fan aperture for movement of air by a fan therethrough;

a mounting member having a first surface on one side of the member for supporting the fan frame thereon, a second surface on the opposite side of the member relative to the first surface, and at least one mounting tab extending outwardly of the first surface and received within the first aperture of the fan frame, the mounting member defining a second aperture formed adjacent to a base of the mounting tab and extending through the mounting member from the first side to the second side thereof, and the mounting member further defining a second fan aperture aligned with the first fan aperture for the movement of air by the fan therethrough and a fastener received within the first aperture of the fan frame and engaging both the mounting tab and the frame to secure the fan frame to the mounting member.

2. A fan assembly as defined in claim 1, wherein the fan frame defines a plurality of first apertures spaced relative to each other, the mounting member defines a plurality of tabs and respective second apertures formed through the member adjacent to the base of each tab, and each mounting tab is aligned with a respective first aperture and received therein, and the fan assembly further comprises a plurality of fasteners with each fastener received within a respective first aperture and engaging the frame and respective mounting tab to secure the fan frame to the mounting member.

3. A fan assembly as defined in claim 1, wherein the second surface of the mounting member defines an approximately planar surface surrounding the at least one first aperture.

4. A fan assembly as defined in claim 3, wherein the second surface of the mounting member defines a uniformly smooth surface surrounding the at least one first aperture.

5. A fan assembly as defined in claim 1, wherein the mounting member is formed of sheet metal.

6. A fan assembly as defined in claim 5, wherein the at least one second aperture and mounting tab are formed by piercing the sheet metal mounting member with a forming tool to thereby form the second aperture, and by moving the forming tool through the second aperture to thereby move the pierced metal outwardly of the first surface into the shape of the mounting tab.

7. A fan assembly as defined in claim 1, wherein the at least one mounting tab is oriented approximately perpendicular to the first surface of the mounting member.

8. A fan assembly as defined in claim 1, wherein the at least one mounting tab defines a first surface engagable with the surface of the fan frame forming the first aperture, and defines a curvature approximately conforming to a curvature of said surface of the fan frame.

9. A fan assembly as defined in claim 8, wherein the at least one mounting tab defines a second surface on approximately the opposite side of the mounting tab relative to the first surface, and the second surface defines a curvature approximately conforming to a curvature of the fastener for engaging the fastener.

10. A fan assembly as defined in claim 1, wherein the fastener threadedly engages both the mounting tab and fan frame to secure the fan frame to the mounting member.

11. A fan assembly as defined in claim 10, wherein the fan frame is made of metal, the mounting member is made of metal, and the fastener is made of metal.

12. A fan assembly as defined in claim 1, wherein the mounting tab is spaced adjacent to the second fan aperture and aligned with the first aperture of the frame and received therein.

13. A fan assembly as defined in claim 12, further comprising a plurality of fan frames, and wherein the mounting member defines a plurality of second fan apertures spaced relative to each other on the mounting member, and a plurality of mounting tabs and respective second apertures, and wherein each mounting tab is spaced adjacent to a respective second fan aperture and is received within a first aperture of a respective fan frame to secure the fan frame to the mounting member.

14. A fan assembly as defined in claim 12, wherein the mounting member forms the wall of a fan rack enclosure.

15. A fan assembly as defined in claim 1, wherein the fan frame forms one of an axial fan and a blower.

16. A fan assembly as defined in claim 1, wherein the at least one mounting tab defines an exterior surface adjacent to the fan frame and an interior surface for engaging the fastener, and the interior surface defines a plurality of surface irregularities for facilitating threadedly engaging the fastener.

17. A cooling apparatus comprising:

first means for moving air and defining a first aperture for mounting the first means;

second means for supporting the first means and defining a first surface for supporting the first means thereon, a second surface formed on an opposite side of the first means relative to the first surface, an air aperture formed through second means for passing the air therethrough, and a second aperture formed through the second means and extending from the first surface to the second surface;

third means formed integral with the second means contiguous to the second aperture, and extending outwardly from the first surface and received within the first aperture of the first means, for positioning the first means on the second means; and fourth means received with the first aperture of the first means for fastening the first means to the second means.

18. A cooling apparatus as defined in claim 17, wherein the first means further defines a first flange seated on the first surface of the second means, a second flange spaced laterally from the first flange, an aperture in the first flange and a corresponding aperture in the second flange for moving air therethrough, and a plenum extending between the first flange and the second flange for moving air therethrough.

19. A cooling apparatus as defined in claim 18, wherein the first flange defines a plurality of first apertures for mounting the first means.

20. A cooling apparatus as defined in claim 17, wherein the second means defines a sheet-like surface.

21. A cooling apparatus as defined in claim 20, wherein the sheet-like surface is made of sheet metal.

22. A cooling apparatus as defined in claim 17, wherein the third means further defines an upwardly projecting tab extending from the first surface and received within the first aperture of the first means for mounting the first means.

23. A cooling apparatus as defined in claim 19, wherein the third means defines a plurality of upwardly projecting tabs extending from the first surface and received within the apertures in the first flange for mounting the first means.

24. A cooling apparatus as defined in claim 17, wherein the fourth means threadedly engages both the first and third means.

25. A cooling apparatus as defined in claim 24, wherein the fourth means comprises a fastener threadedly engaging both the first means and the third means.

26. A method of making a fan assembly including a fan frame defining at least one first aperture, a mounting member supporting the fan frame thereon, and at least one fastener securing the fan frame to the mounting member, the method comprising the following steps:

piercing the mounting member with at least one forming tool to form a second aperture therethrough;

moving the forming tool into the second aperture and, in turn, moving the pierced material of the mounting member outwardly and thereby forming the pierced material into a mounting tab defining an approximately predetermined shape;

placing the fan frame onto the mounting member with the mounting tab received within the first aperture of the frame; and inserting a fastener into the first aperture of the frame and engaging with the fastener both the fan frame and the mounting tab to secure the fan frame to the mounting member.

27. A method of making a fan assembly as defined in claim 26, further comprising the steps of forming the mounting member of sheet metal and piercing the sheet metal with the at least one forming tool to form the second aperture and mounting tab.

28. A method of making a fan assembly as defined in claim 26, wherein the step of piercing the mounting member with at least one forming tool further comprises forming a plurality of second apertures through the mounting member and moving the forming tool into the plurality of second apertures to thereby move the pierced metal outwardly of the mounting member and form the pierced metal into a plurality of mounting tabs.

29. A method of making a fan assembly as defined in claim 26, wherein the step of piercing the mounting member with at least one forming tool further comprises forming the pierced metal into a mounting tab oriented approximately perpendicular to the mounting member.

30. A method of making a fan assembly as defined in claim 26, wherein the step of inserting a fastener into the mounting aperture comprises inserting a self-tapping fastener into the mounting aperture and forming threads with the fastener on the mounting tab and fan frame to threadedly engage same.

31. A fan assembly comprising:

a fan frame defining at least one first aperture;

a mounting member defining a first surface on one side of the member for supporting the fan frame thereon, a second surface on the opposite side of the member relative to the first surface, at least one mounting tab extending outwardly of the first surface and received within the first aperture of the fan frame, and a second aperture formed adjacent to a base of the mounting tab and extending through the mounting member from the first side to the second side thereof; and a fastener received within the first aperture of the fan frame and engaging both the mounting tab and the frame to secure the fan frame, to the mounting member, wherein the fan frame defines a plurality of first apertures spaced relative to each other, the mounting member defines a plurality of tabs and respective second apertures formed through the member adjacent to the base of each tab, and each mounting tab is aligned with a respective first aperture and received therein, and the fan assembly further comprises a plurality of fasteners with each fastener received within a respective first aperture and engaging the frame and respective mounting tab to secure the fan frame to the mounting member.

32. A fan assembly comprising:

a fan frame defining at least one first aperture;

a mounting member defining a first surface on one side of the member for supporting the fan frame thereon, a second surface on the opposite side of the member relative to the first surface, at least one mounting tab extending outwardly of the first surface and received within the first aperture of the fan frame, and a second aperture formed adjacent to a base of the mounting tab and extending through the mounting member from the first side to the second side thereof, wherein the mounting member is formed of sheet metal; and a fastener received within the first aperture of the fan frame and engaging both the mounting tab and the frame to secure the fan frame to the mounting member.

33. A fan assembly as defined in claim 32, wherein the at least one second aperture and mounting tab are formed by piercing the sheet metal mounting member with a forming tool to thereby form the second aperture, and by moving the forming tool through the second aperture to thereby move the pierced metal outwardly of the first surface into the shape of the mounting tab.

34. A fan assembly comprising:

a fan frame defining at least one first aperture;

a mounting member defining a first surface on one side of the member for supporting the fan frame thereon, a second surface on the opposite side of the member relative to the first surface, at least one mounting tab extending outwardly of the first surface and received within the first aperture of the fan frame, and a second aperture formed adjacent to a base of the mounting tab and extending through the mounting member from the first side to the second side thereof; and a fastener received within the first aperture of the fan frame and engaging both the mounting tab and the frame to secure the fan frame to the mounting member, wherein the fastener threadedly engages both the mounting tab and fan frame to secure the fan frame to the mounting member.

35. A fan assembly comprising:

a fan frame defining at least one first aperture;

a mounting member defining a first surface on one side of the member for supporting the fan frame thereon, a second surface on the opposite side of the member relative to the first surface, at least one mounting tab extending outwardly of the first surface and received within the first aperture of the fan frame, and a second aperture formed adjacent to a base of the mounting tab and extending through the mounting member from the first side to the second side thereof; and a fastener received within the first aperture of the fan frame and engaging both the mounting tab and the frame to secure the fan frame to the mounting member, wherein the at least one mounting tab defines an exterior surface adjacent to the fan frame and an interior surface for engaging the fastener, and the interior surface defines a plurality of surface irregularities for facilitating threadedly engaging the fastener.

36. A cooling apparatus comprising:

first means for moving air and defining a first aperture for mounting the first means;

second means for supporting the first means and defining a first surface for supporting the first means thereon, a second surface formed on an opposite side of the first means relative to the first surface, and a second aperture formed through the second means and extending from the first surface to the second surface, wherein the second means defines a sheet-like surface made of sheet metal;

third means formed integral with the second means contiguous to the second aperture, and extending outwardly from the first surface and received within the first aperture of the first means, for positioning the first means on the second means; and fourth means received with the first aperture of the first means for fastening the first means to the second means.

37. A cooling apparatus comprising:

first means for moving air and defining a first aperture for mounting the first means;

second means for supporting the first means and defining a first surface for supporting the first means thereon, a second surface formed on an opposite side of the first means relative to the first surface, and a second aperture formed through the second means and extending from the first surface to the second surface;

third means formed integral with the second means contiguous to the second aperture, and extending outwardly from the first surface and received within the first aperture of the first means, for positioning the first means on the second means; and fourth means received with the first aperture of the first means for fastening the first means to the second means, wherein the fourth means threadedly engages both the first and third means.

38. A cooling apparatus as defined in claim 37, wherein the fourth means comprises a fastener threadedly engaging both the first means and the third means.

* * * * *